US007828602B2

(12) United States Patent
Su et al.

(10) Patent No.: US 7,828,602 B2
(45) Date of Patent: Nov. 9, 2010

(54) ELECTRICAL CONNECTOR WITH IMPROVED CONTACT FACILITATING LOW INSERTION FORCE

(75) Inventors: Ping-Sheng Su, Tu-Cheng (TW); Xiao-Li Li, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 123 days.

(21) Appl. No.: 12/215,538

(22) Filed: Jun. 26, 2008

(65) Prior Publication Data

US 2009/0004925 A1 Jan. 1, 2009

(51) Int. Cl.
*H01R 24/04* (2006.01)

(52) U.S. Cl. ..... 439/668

(58) Field of Classification Search ..... 439/668–669
See application file for complete search history.

(56) References Cited

U.S. PATENT DOCUMENTS 5,022,872 A * 6/1991 Shichida ..... 439/668
6,296,525 B1 * 10/2001 D'Addario et al. ..... 439/668
7,134,890 B2 11/2006 Wang
7,186,141 B2 3/2007 Li et al.
2006/0258212 A1 11/2006 Li et al.

* cited by examiner

*Primary Examiner*—Briggitte R Hammond
(74) *Attorney, Agent, or Firm*—Wei Te Chung; Andrew C. Cheng; Ming Chieh Chang

(57) ABSTRACT

An electrical connector (100) includes an insulative housing (1) having a receiving cavity (110) and a passageway (1130) in communication with the receiving cavity therein, and an electric contact (3) received in the passageway and extending into the receiving cavity for contacting with a complementary connector. The receiving cavity has a pair of surfaces opposite to each other, with one of said surfaces attached to said passageway and the other one standing far away from the passage. The contact has first and second elastic contact engaging portions (311, 313) for physically and electrically connecting with the complementary connector, and the first contact engaging portion is closer to said the other surface of the receiving cavity than the second contact engaging portion.

15 Claims, 7 Drawing Sheets

ELECTRICAL CONNECTOR WITH IMPROVED CONTACT FACILITATING LOW INSERTION FORCE

BACKGROUND OF THE INVENTION

1. Field of the Invention

This invention generally relates to an electrical connector, and more particularly, to an electrical connector with an improved contact which has a low insertion force in mating with a complementary connector.

2. Description of the Prior Art

Power jacks/plugs are widely used in the electrical industry to connect power supplies with electrical devices, such as mobile phone, note book. The power jack generally comprises a dielectric housing, an inner contact and an outer contact respectively served as a positive pole and a negative pole of a power supply for providing voltage to electrical device connecting to the power connector, and a signal contact provided for signal transmission. However, the contacts sustain a large insertion force when mating with a complementary connector, so abrasion loss of the contacts is heavy after some time.

Hence, an improved electrical connector is desired to overcome the above problem.

BRIEF SUMMARY OF THE INVENTION

It is an object of the present invention to provide an electrical connector with an improved contact which has a lower abrasion loss in mating with a complementary connector.

In order to attain the object above, an electrical connector according to the present invention includes an insulative housing having a receiving cavity and a passageway in communication with the receiving cavity therein, and an electric contact received in the passageway and extending into the receiving cavity for contacting with a complementary connector. The receiving cavity has a pair of surfaces opposite to each other, with one of said surfaces attached to said passageway and the other one standing far away from the passage. The contact has first and second elastic contact engaging portions for physically and electrically connecting with the complementary connector, and the first contact engaging portion is closer to said the other surface of the receiving cavity than the second contact engaging portion.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
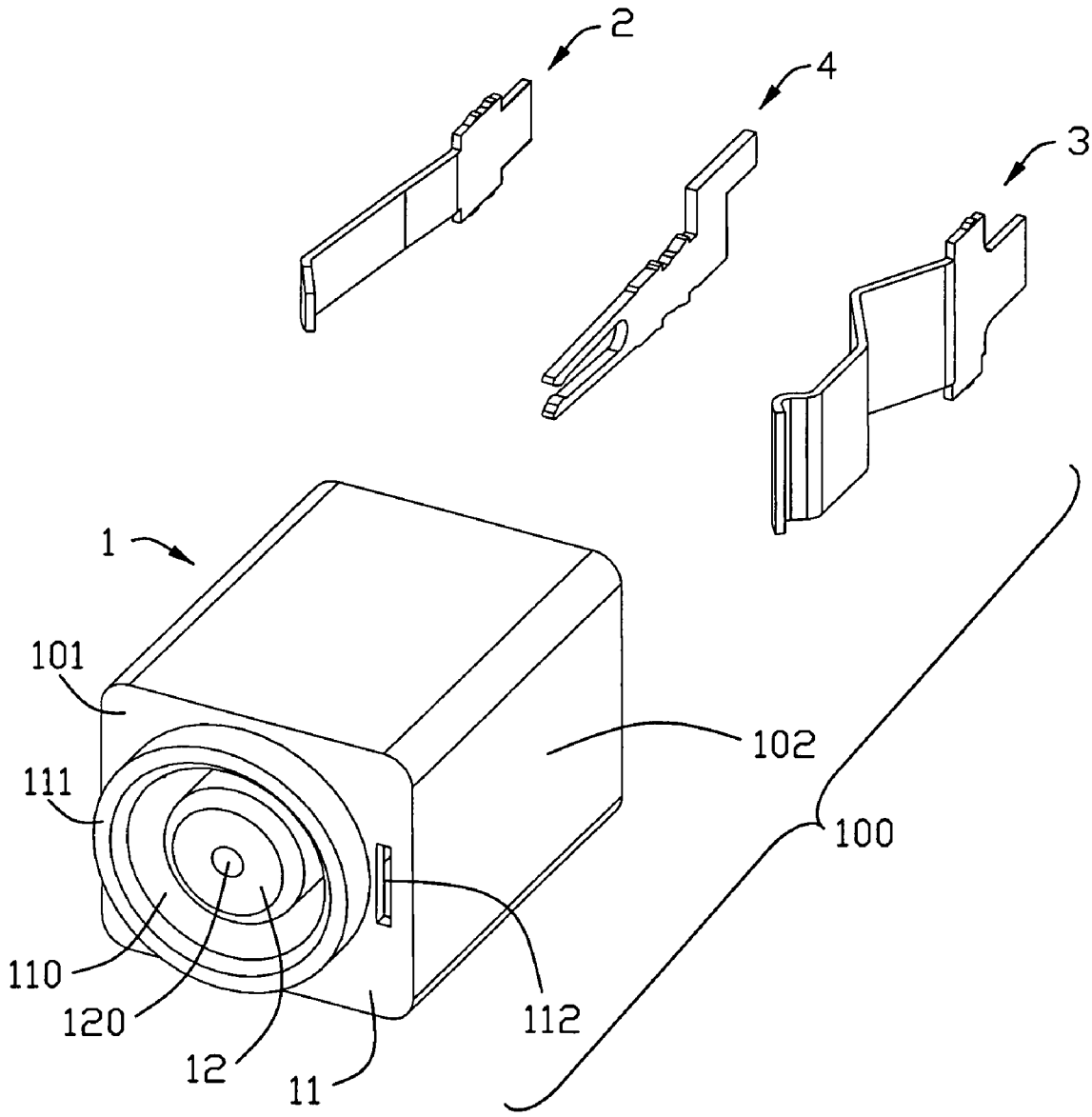
FIG. 1 is an exploded, perspective view of an electrical connector in accordance with the present invention.

Reference will now be made in detail to the preferred embodiment of the present invention.

Referring to FIGS. 1-7, an electrical connector 100 in accordance with the preferred embodiment of the present invention is assembled in an complementary connector and comprises an insulative housing 1, a pair of first and second contacts 2 and 3 adapted for power transmission, and a third contact 4 used for signal transmission. The first contact 2 is the anode of the power connector and the second contact 3 is the cathode of the power connector. In the preferred embodiment, the power connector 100 further comprises a cable (not shown) having a plurality of conductors (not shown) respectively solderable to the first, second and third contacts 2, 3 and 4.

Figure 2:
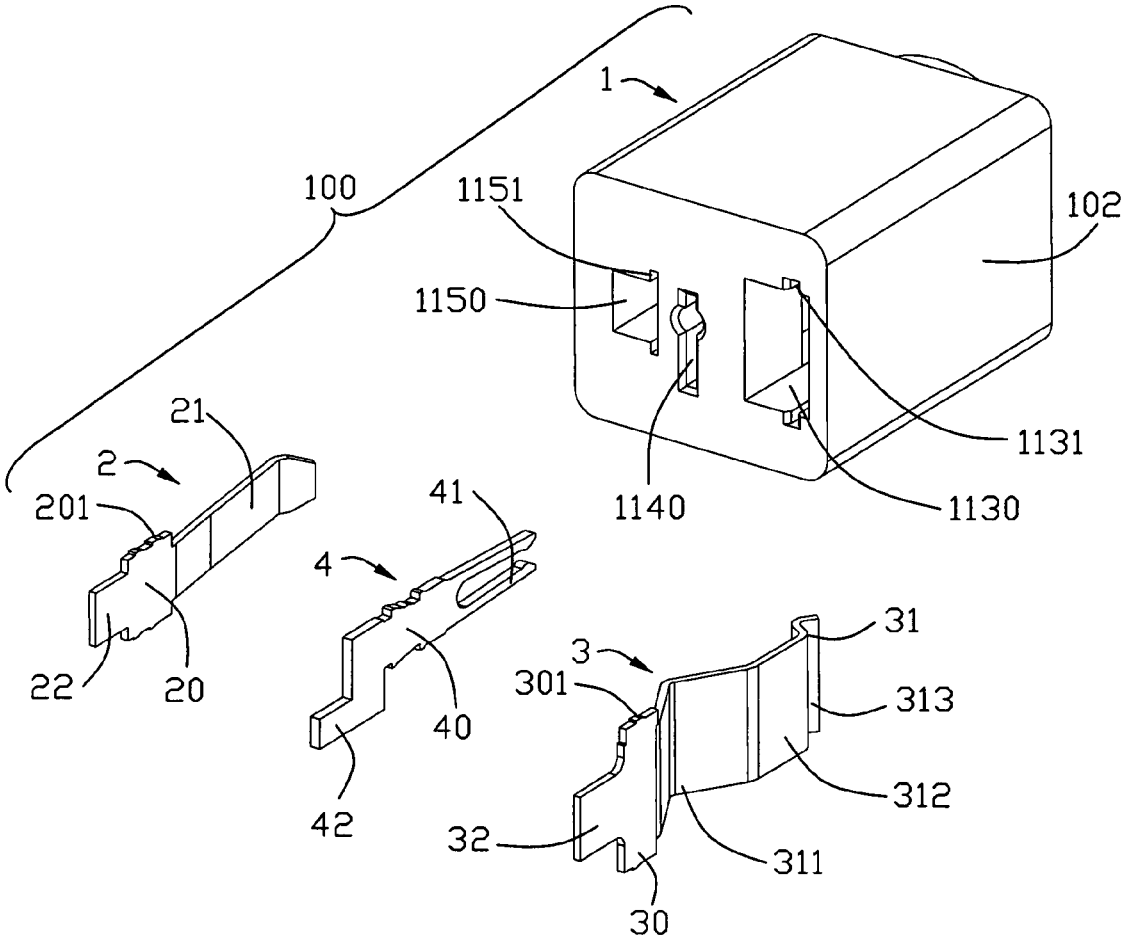
FIG. 2 is a view similar to FIG. 1, but viewed from another aspect.
Figure 3:
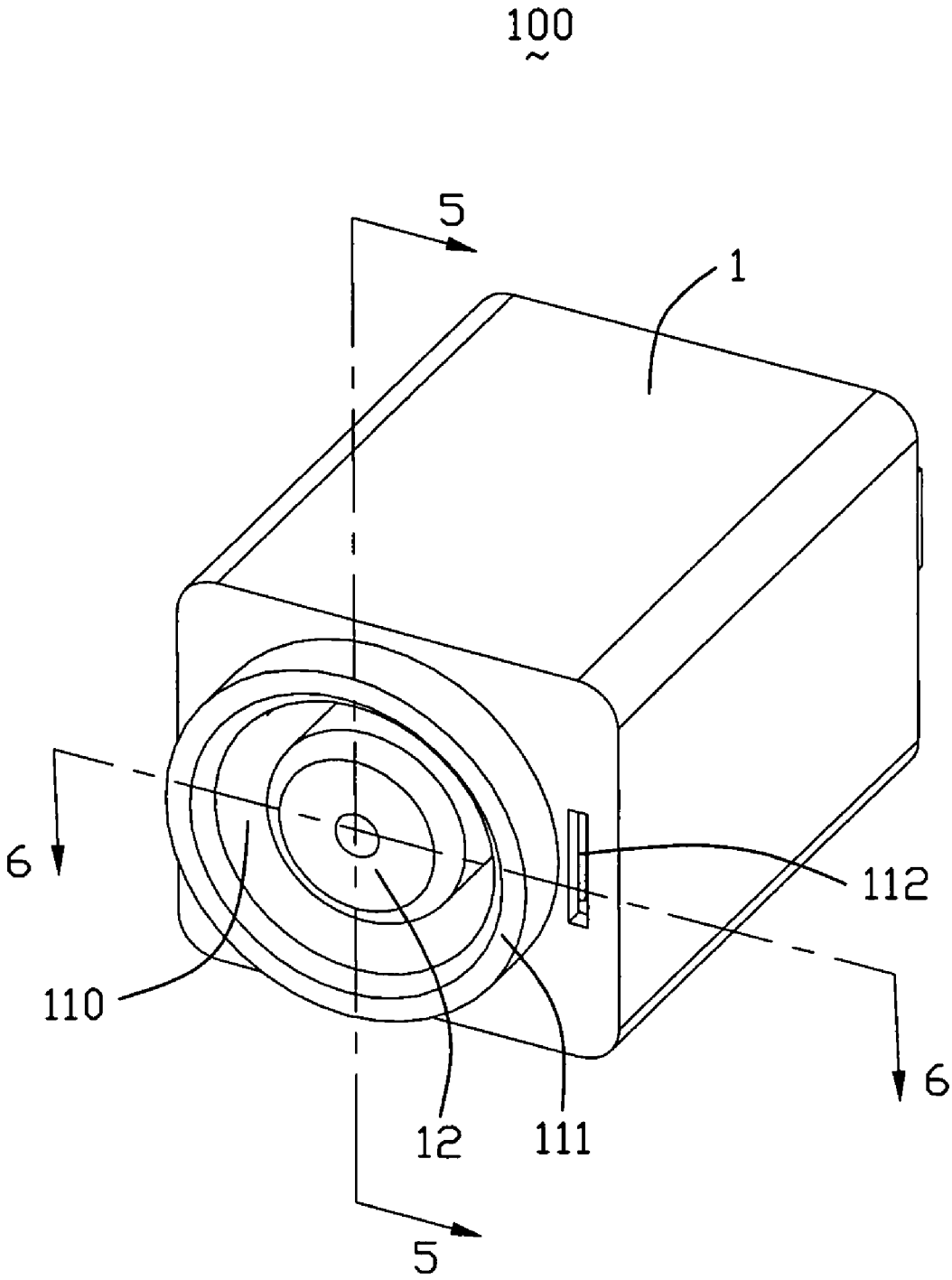
FIG. 3 is an assembled view of the electrical connector shown in FIG. 1.

Please referring to FIGS. 1-2, the insulative housing 1 is approximately in the shape of a cubical block and defines a front face 101 with a rectangular hole 1 12 thereon and a pair of side surfaces 102 perpendicular to the front face 101. The housing 1 is formed with a first housing portion 11 defining a center receiving cavity 110 and a cylindrical second housing portion 12 protruding into the receiving cavity 110 of the first housing portion 11. The second housing portion 12 has a front face (not labeled) flush with the front face 101 and defines a fine receiving groove 120 along a longitudinal axis thereof. A round rim 111 is formed on the front face 101 of the insulative housing 1 along a front fringe of the receiving cavity 110.

Figure 4:
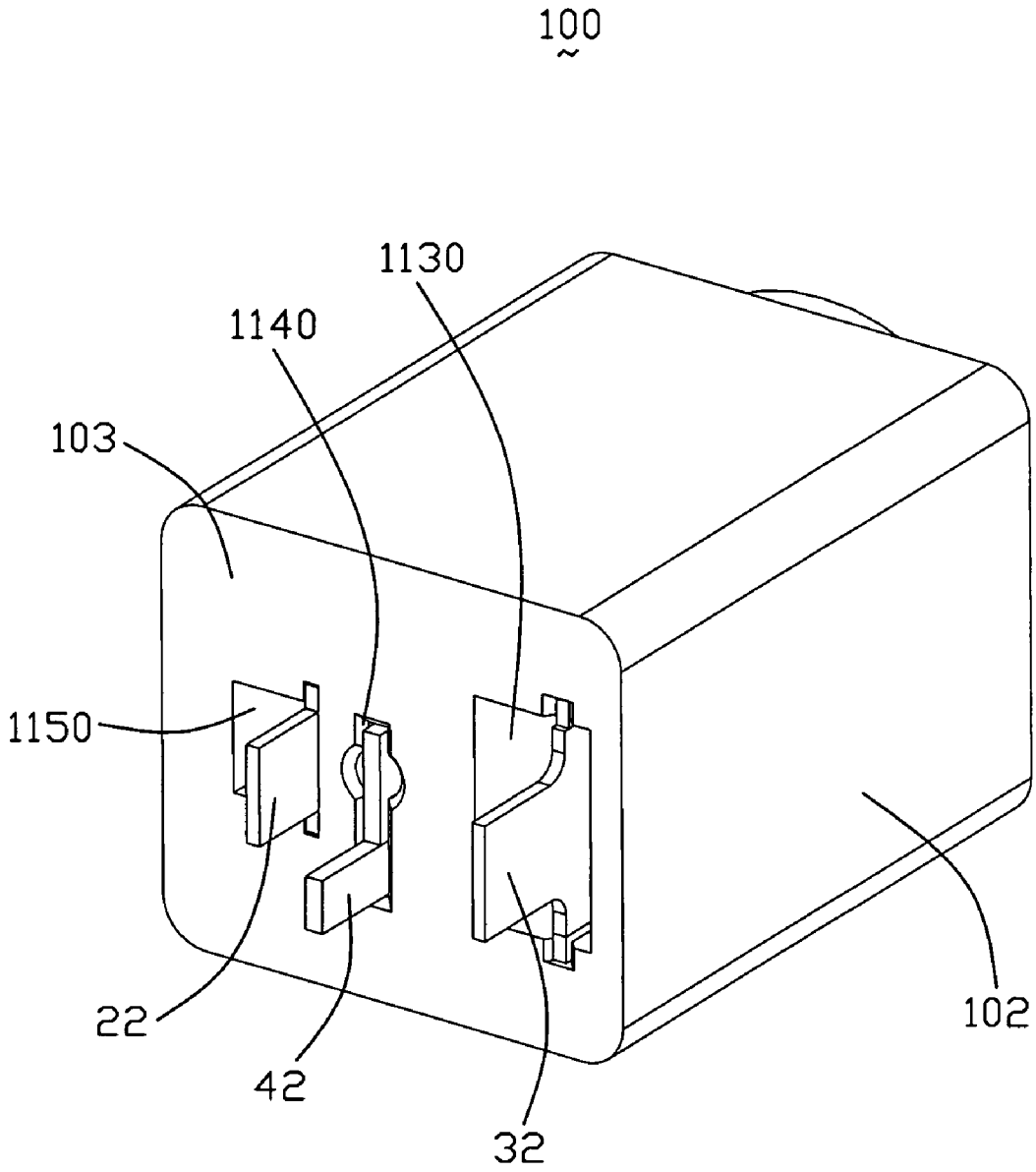
FIG. 4 is a view similar to FIG. 3, but viewed from another aspect.
Figure 5:
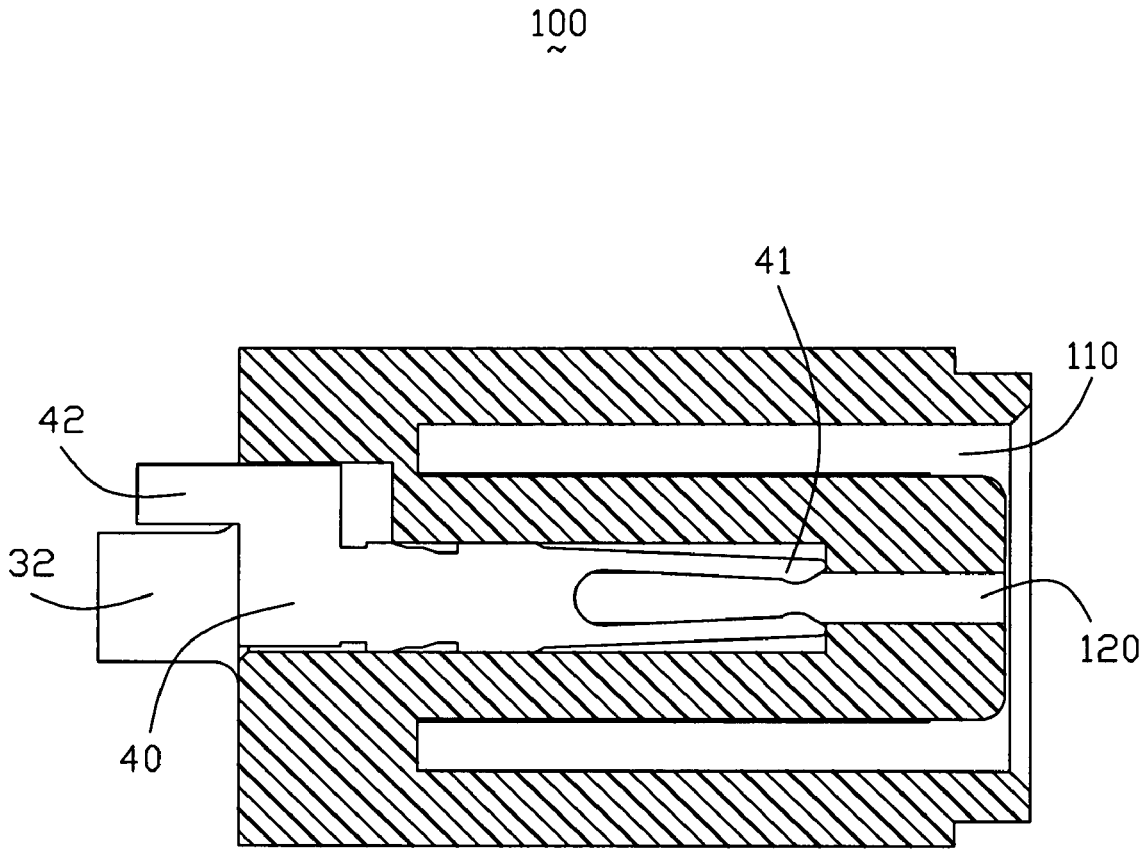
FIGS. 5-7 are cross-sectional views of FIG. 3 taken along lines 5-5 and 6-6.

Please referring to FIGS. 2 and 4, the insulative housing 1 has first, second and third passageways 1130, 1140 and 1150 on its rear surface 103 to receive the contacts 2, 3 and 4. The second passageway 1140 communicates with the receiving groove 120, so the third contact 4 received in the second passageway 1140 can electrically engage with a part of a complementary connector received in the receiving groove 120. The first passageway 1130 communicates with the rectangular hole 112 and has a first guiding slot 1131 for engaging with and holding the second contact 3. The first housing portion 11 forms a pivot 1132 adjacent to the first passageway 1130. The third passageway 1150 has a third guiding slot 1151 for engaging with and holding the first contact 2. The first and third passageway 1130 and 1150 communicate with the center receiving cavity 110, so the second and first contacts 3 and 2 respectively received in the passageway 1130 and 1150 can electrically engage with another part of a complementary connector received in center receiving cavity 110.

Figure 6:
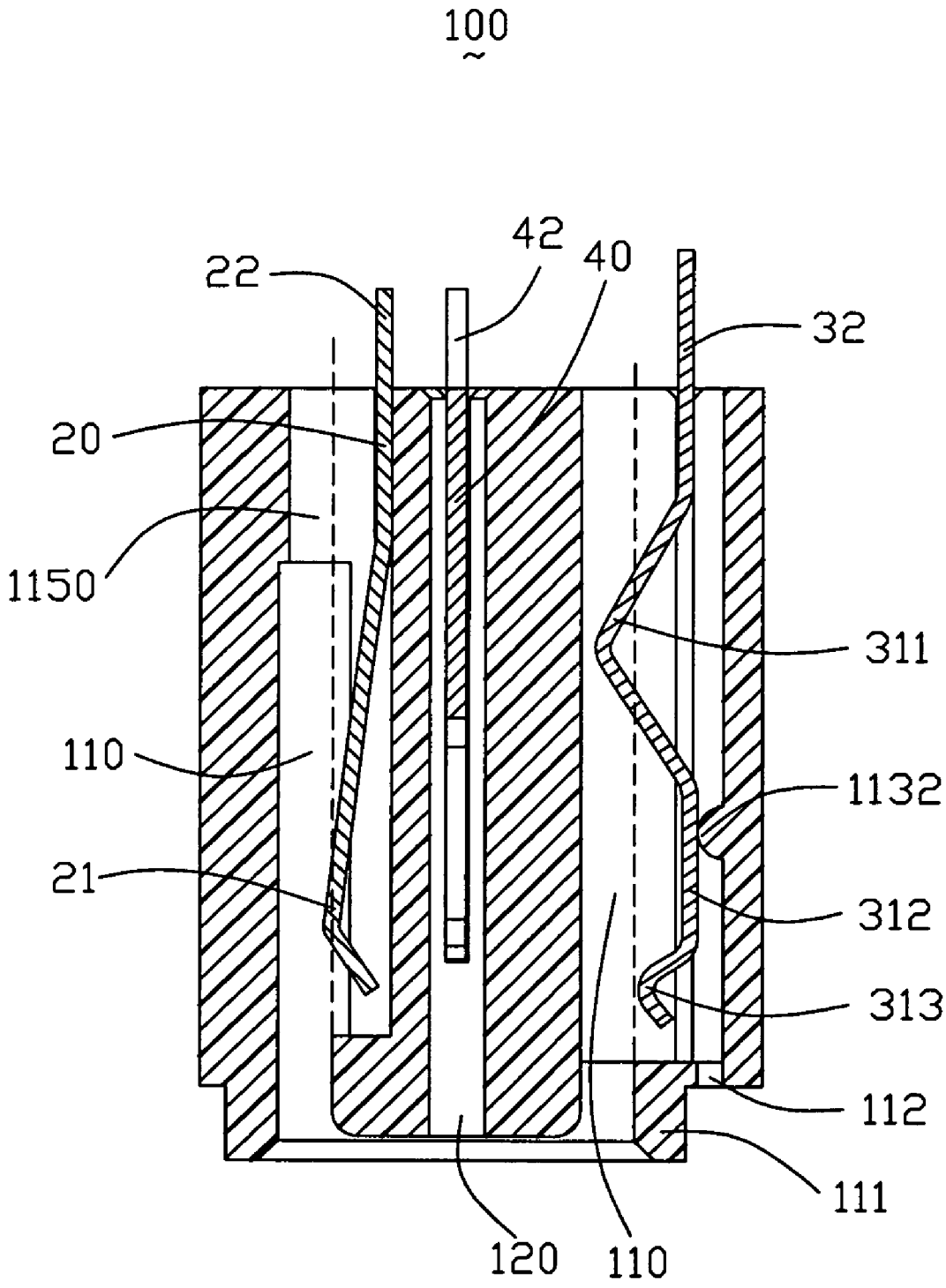
Figure 7:
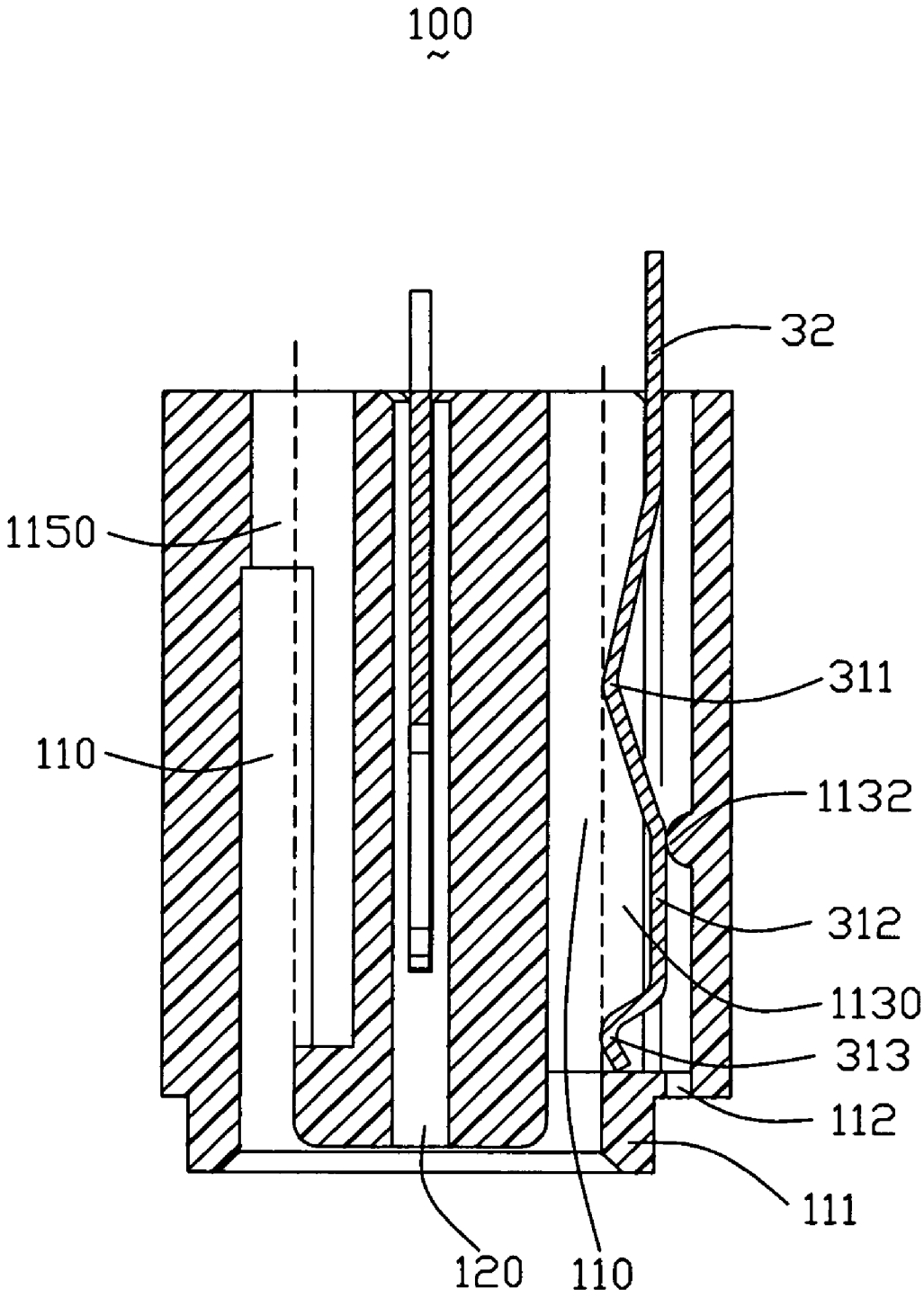

Referring to FIGS. 1-2 and 6, the first contact 2 is inserted into the third passageway 1150 from a rear side of the housing 1 to serve as a positive pole of the power supply. The first contact 2 is formed with a main portion 20, an elastic contacting portion 21 extending forwards from the main portion 20 and a tail portions 22 extending rearwards from the main portion 20. The main portion 20 forms a plurality of barbs 201 thereon for positioning purpose. The contacting portion 21 extends into the receiving cavity 110 for electrically contacting a complementary connector, and the tail portion 22 extends beyond the rear surface 103 of the housing 1 to be soldered with a cable.

The second contact 3 is inserted into the insulative housing 1 from the rear surface 103, and comprises a retaining portion 30 with some barbs 301 thereof for engaging with the first guiding slot 1131, a curved elastic contacting portion 31 extending forwards from the retaining portion 30, a tail portion 32 extending rearwards beyond the insulative housing 1. The contacting portion 31 includes a first contact engaging portion 311, a second contact engaging portion 313, and a connecting portion 312 between the first and second contact engaging portion 311 and 313. The first contact engaging portion 311 is V-shaped and at first extends forwards and inwards from the retaining portion 30 to enter the receiving cavity 110, and then extends forwards and outwards to connect with the connecting portion 312. The connecting portion 312 extends parallel to the second housing portion 12. The second contact engaging portion 313 is of hook-type, and at first extends forwards and inwards from the connecting portion 32 to approach the receiving cavity 110, and then extends forwards and outwards to form a free end. The first contact engaging portion 311 is closer to the second housing portion 12 than the second contact engaging portion 313, so it can provide a greater force to the complementary connector. The connecting portion 312 is received in the first guiding slot 1131 and abuts against the pivot 1132, so the second contact can rotate about the pivot 1132 when forced.

Please referring to FIGS. 2-6, the third contact 4 is received in the second passageway 1140 of the insulative housing 1 on a vertical plane and comprises a fork-shape mating portion 41 exposed to the receiving groove 120, a securing portion 40 extending rearwards from the mating portion 41 and a connecting portion 42 extending upwards and rearwards from the securing portion 40. The securing portion 40 forms a plurality of barbs (not labeled) at opposite sides thereof for interferential engaging with inner walls of the second passageway 1140, thereby securely retaining the third contact 4 in the housing 1.

Please referring to FIGS. 3-7, when a complementary connector (not shown) is inserted in the connector 100, the complementary connector at first contacts with the V-shaped bottom portion of the first contact engaging portion 311 of the second conductive contact 3 and make the first contact engaging portion 311 to move outwards. In accordance, the second contact engaging portion 313 rotates inwards about the pivot 1132 till it abuts against the complementary connector. Therefore, the electrical connection between the second contact engaging portion 313 and the complementary connector is completed without sliding friction between the second contact engaging portion 313 and the complementary connector. The first contact engaging portion 311 is plated by non-precious metal as a non-main contacting area, and the second contact engaging portion 313 is plated by precious metal as a main contacting area because of its high conductivity. The first contact engaging portion 311, as a main holding area for holding the complementary connector, can avoid sliding friction of the second contact engaging portion 313 and reduce wear and tear of the second contact engaging portion 313.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector adapted for mating with a complementary connector, comprising:

an insulative housing defining a receiving cavity, a passageway in communication with the receiving cavity and a pivot in the passageway, the receiving cavity having a pair of surfaces opposite to each other, one of said surfaces attached to said passageway, the other of said surfaces standing far away from said passageway; and an electric contact received in the passageway and extending into the receiving cavity for contacting with the complementary connector;

wherein the contact comprises first and second elastic contact engaging portions for physically and electrically connecting with the complementary connector, the first contact engaging portion is closer to the other of said surfaces of the receiving cavity than the second contact engaging portion, and the second contact engaging portion is closer to a front surface of the housing than the first contact engaging portion, with the pivot disposed between the first and the second contact engaging portions.

2. The electrical connector according to claim 1, wherein the second contact engaging portion doesn't extend into the receiving cavity before mating with the complementary connector.

3. The electrical connector according to claim 1, wherein the housing comprises a first housing portion in the periphery thereof and a second housing portion in the center thereof, the receiving cavity is defined between the first and second housing portions; the contact is disposed on one of the first and second housing portions, the first contact engaging portion is closer to the other of the first and second housing portions than the second contact engaging portion.

4. The electrical connector according to claim 3, wherein a signal contact is disposed in the center of the second housing portion.

5. The electrical connector according to claim 1, wherein the first contact engaging portion is plated by non-precious metal, and the second contact engaging portion is plated by precious metal.

6. The electrical connector according to claim 5, wherein the first and second contact engaging portions are of V-shaped type.

7. An electrical connector, comprising:

an insulative housing defining a receiving cavity and a passageway in communication with the receiving cavity, a pivot being integrally formed with the insulative housing; and a contact received in the passageway and including a first contact engaging portion extending from the passageway into the receiving cavity, and a second contact engaging portion remained within the passageway, and the pivot disposed between the first and second contact engaging portions, the second contact engaging portion rotating about the pivot to engage with a complementary connector when the complementary connector inserted to engage with the first contact engaging portion, and the second contact engaging portion slightly deflecting towards the receiving cavity when the first contact engaging portion is pushed back toward the passageway.

8. The electrical connector according to claim 7, wherein the first contact engaging portion is plated by non-precious metal, and the second contact engaging portion is plated by precious metal.

9. The electrical connector according to claim 7, wherein the first contact engaging portion is plated by non-precious metal, and the second contact engaging portion is plated by precious metal.

10. The electrical connector according to claim 7, wherein the housing comprises a first housing portion in the periphery thereof and a second housing portion in the center thereof, the receiving cavity is defined between the first and second housing portions; the contact is disposed on one of the first and second housing portions, the first contact engaging portion is closer to the other of the first and second housing portions than the second contact engaging portion.

11. The electrical connector according to claim 10, wherein a signal contact is disposed in the center of the second housing portion.

12. An electrical connector for mating with a complementary connector, comprising:

an insulative housing defining a mating port through a front face of the housing for receiving said complementary connector;

at least one contact disposed in the housing and including front and rear contacting sections around said mating port, wherein the rear contacting section constantly extends into the mating port disregarding whether the complementary connector is inserted into the mating port, while the front contacting section extends into the mating port only when the rear contacting section is pressed outwards by the complementary connector; wherein said contact includes an internal fulcrum point located between the front contacting section and said rear contacting section to form a lever operation therebetween, and the housing forms an external fulcrum point to allow said internal fulcrum point abutting thereaginst.

13. The electrical connector as claimed in claim 12, wherein a retention portion of contact with regard to the housing is located behind the rear contacting section.

14. The electrical connector as claimed in claim 12, wherein one of said internal and external fulcrum points is a bump located in a corresponding passageway of the housing under a condition that the passageway is communicatively beside the mating port and the contact is essentially disposed in the passageway.

15. The electrical connector as claimed in claim 14, wherein said bump is unitarily formed on the housing.

* * * * *